US006784910B2

(12) United States Patent
Sato et al.

(10) Patent No.: US 6,784,910 B2
(45) Date of Patent: Aug. 31, 2004

(54) THERMAL HEAD, THERMAL ACTIVATION DEVICE FOR THERMALLY ACTIVE SHEET AND PRINTER ASSEMBLY

(75) Inventors: Yoshinori Sato, Chiba (JP); Shinichi Yoshida, Chiba (JP); Minoru Hoshino, Chiba (JP); Norimitsu Sambongi, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/607,298

(22) Filed: Jun. 26, 2003

(65) Prior Publication Data

US 2004/0046857 A1 Mar. 11, 2004

(30) Foreign Application Priority Data

Jul. 17, 2002 (JP) ..... 2002-208557

(51) Int. Cl.[7] ..... B41J 2/315; B41J 2/32; B41J 2/335

(52) U.S. Cl. ..... 347/203; 347/171

(58) Field of Search ..... 347/171, 200, 347/203

(56) References Cited

U.S. PATENT DOCUMENTS

| | | | | | |
|---|---|---|---|---|---|
| 2,036,686 | A | | 3/1936 | Sugaya et al. | 347/203 |
| 5,846,358 | A | * | 12/1998 | Nagamoto et al. | 156/64 |
| 6,031,553 | A | * | 2/2000 | Nagamoto et al. | 347/171 |
| 6,172,698 | B1 | * | 1/2001 | Iwata et al. | 347/171 |
| 6,501,495 | B1 | * | 12/2002 | Ichikawa et al. | 347/171 |

FOREIGN PATENT DOCUMENTS

| | | | | |
|---|---|---|---|---|
| EP | 0763431 | | 3/1997 | |
| EP | 1075957 | | 2/2001 | |
| EP | 1176022 | | 1/2002 | |
| EP | 1384590 | A1 * | 1/2004 | B41J/2/315 |
| JP | 62-048569 | * | 3/1987 | B41J/3/20 |
| JP | 3-51144 | * | 3/1995 | B41J/2/335 |

OTHER PUBLICATIONS

Patent Abstracts of Japan, vol. 011, No. 235 (M–612), Jul. 31, 1987, publication No. 62 048569 A (Fujitsu Ltd), publication date Mar. 3, 1987.

Patent Abstracts of Japan, vol. 015, No. 505 (M–1194), Dec. 20, 1991, publication No. 03 222760 A (Alps Electric Co Ltd), publication date Oct. 1, 1991.

* cited by examiner

*Primary Examiner*—Huan Tran
(74) *Attorney, Agent, or Firm*—Adams & Wilks

(57) ABSTRACT

Providing a thermal head capable of preventing the adherence of a thermally active component, a thermal activation device for thermally active sheet employing the thermal head, and a printer assembly employing the thermal activation device. A thermal head has an arrangement wherein a heat storage layer (glaze layer 2) is formed on a heat releasing substrate (ceramic substrate 1), wherein plural heat generating resistances (3) and electrodes (4*a*, 4*b*) for power supply to the individual heat generating resistances are formed on the heat storage layer thereby forming an array of heat generating elements, and wherein a protective layer (7) covers the top surfaces of these parts; and applies thermal activation energy to a print medium (heat-sensitive self-adhesive label R) including a thermally active component by supplying power to the heat-generating element array, the thermal head provided with two substantially parallel lines of anti-adherence layers against thermally-active-component (8*a*, 8*b*) on the protective layer in a manner to sandwich a protective layer portion directly above the heat-generating element array.

14 Claims, 7 Drawing Sheets

THERMAL HEAD, THERMAL ACTIVATION DEVICE FOR THERMALLY ACTIVE SHEET AND PRINTER ASSEMBLY

BACKGROUND OF THE INVENTION

1. Field of the Invention

The present invention relates to a thermal head for applying thermal activation energy to a thermally active sheet including a thermally active component; a thermal activation device employing the thermal head; and a printer assembly employing the thermal activation device. More particularly, the invention relates to a technique for preventing the activated thermally active component from being adhered to the thermal head.

2. Description of the Related Art

In recent years, a thermally active sheet (a print medium containing a thermally active component in a top coat surface thereof and exemplified by a heat-sensitive self-adhesive label) has been known as a kind of labels affixed to products. The thermally active sheets have found a wide range of applications such as POS labels affixed to food products, affixing labels used in physical distribution/delivery, labels affixed to medical products, baggage tugs, indication labels affixed to bottles or cans and the like.

The heat-sensitive self-adhesive label includes a sheet-like label substrate (such as a base paper); a heat-sensitive adhesive layer formed on a back side of the substrate and containing a thermally active component which is normally non-adhesive but develops adhesiveness when heated; and a printable surface formed on a front side of the substrate.

The heat-sensitive adhesive includes a thermoplastic resin, a solid plasticizer and the like as the major components thereof, and has a nature that the heat-sensitive adhesive is non-adhesive at normal temperatures but is activated to develop the adhesiveness when heated by the thermal activation device. Normally, activation temperatures are in the range of 50 to 150° C., in which range the solid plasticizer in the heat-sensitive adhesive is molten to impart the adhesiveness to the thermoplastic resin. The molten solid plasticizer is gradually crystallized via a supercooled phase so that the adhesiveness is maintained for a given period of time. While the heat-sensitive adhesive exhibits the adhesiveness, the label is affixed to an object such as a glass bottle or the like.

The printable surface of the heat-sensitive self-adhesive label is comprised of, for example, a heat-sensitive color-developing layer containing a kind of thermally active component. The heat-sensitive self-adhesive label is subjected to a thermal printer assembly equipped with a common thermal head for printing a desired character(s) or image on the printable surface thereof and thereafter, subjected to the thermal activation device for activation of the heat-sensitive adhesive layer thereof.

On the other hand, a printer assembly is now under development, which incorporates therein the thermal activation device for sequentially conducting thermal printing on the heat-sensitive self-adhesive label and activation of the heat-sensitive adhesive layer thereof.

Such a printer assembly has an arrangement as shown in FIG. 9, for example.

Referring to FIG. 9, a reference sign P2 represents a thermal printer unit, a sign C2 represents a cutter unit, a sign A2 represents a thermal activation unit, and a sign R represents a heat-sensitive self-adhesive label wound into a roll.

The thermal printer unit P2 includes a printing thermal head 100, a platen roller 101 pressed against the printing thermal head 100, and an unillustrated drive system (including an electric motor, and gear array, for example) for rotating the platen roller 101.

As seen in FIG. 9, the platen roller 101 is rotated in a direction D1 (clockwise) there by paying out the heat-sensitive self-adhesive label R, which, in turn, is subjected to thermal printing and then discharged in a direction D2 (rightward).

The platen roller 101 further includes unillustrated pressure means (such as a helical spring or plate spring), a resilient force of which acts to bias the platen roller 101 surface against the thermal head 100. Thus, the platen roller also operates as pressure means for pressing the heat-sensitive self-adhesive label R.

The printer unit P2 shown in FIG. 9 operates the printing thermal head 100 and platen roller 101 based on a print signal from an unillustrated print control unit, thereby accomplishing desired printing on a thermal coat layer 501 of the heat-sensitive self-adhesive label R.

The cutter unit C2 serves to cut the heat-sensitive self-adhesive label R, thermally printed by the thermal printer unit P2, in a proper length. The cutter unit includes a movable blade 200 operated by a drive source (not shown) such as an electric motor, and a fixed blade 201. The movable blade 200 is operated at a predetermined timing under control of the unillustrated control unit.

The thermal activation unit A2 includes an insertion roller 300 and a discharge roller 301 rotated by, for example, an unillustrated drive source for inserting and discharging the cut heat-sensitive self-adhesive label R; and a thermally-activating thermal head 400 and a platen roller 401 pressed against the thermally-activating thermal head 400, which are interposed between the insertion roller 300 and the discharge roller 301. The platen roller 401 includes an unillustrated drive system (an electric motor and gear array, for example), which rotates the platen roller 401 in a direction D4 (a counterclockwise direction as seen in FIG. 9) so that the heat-sensitive self-adhesive label R is conveyed in a direction D6 (a rightward direction as seen in FIG. 9) by the insertion roller 300 and discharge roller 301 rotated in respective directions D3 and D5. On the other hand, the platen roller 401 includes unillustrated pressure means (such as a helical spring or plate spring), a resilient force of which acts to bias the platen roller 401 surface against the thermally-activating thermal head 400.

A reference sign S represents a discharge detection sensor for detecting the discharge of a heat-sensitive self-adhesive label R. The printing, conveyance and thermal activation of the subsequent heat-sensitive self-adhesive label R are performed in response to the discharge detection sensor S detecting the discharged heat-sensitive self-adhesive label R.

The thermally-activating thermal head 400 has an arrangement as shown in FIG. 11, for example.

Referring to FIG. 11, a reference sign 600 represents a ceramic substrate as a heat releasing substrate. A glaze layer 601 as a heat storage layer is overlaid on the overall surface of the ceramic substrate 600 in a thickness on the order of say 60 $\mu$m. The glaze layer 601 is formed by, for example, printing a glass paste on the substrate followed by baking the paste at predetermined temperatures (e.g., about 1300 to 1500° C.).

A heat generating resistance 602, such as of Ta—$SiO_2$, is formed on the glaze layer 601 by laminating a Ta—$SiO_2$ layer thereon by sputtering and processing the resultant layer into a predetermined pattern by a photolithography technique.

Also formed on the glaze layer 601 is an IC portion 605 for controlling power supply to the heat generating resistance 602. A sealing portion 606, such as of a resin, is overlaid on the IC portion for protection.

On the heat generating resistance 602, an electrode 603 is formed by laminating a layer of Al, Cu, Au or the like by sputtering in a thickness of about 2 $\mu$m and processing the resultant layer into a predetermined pattern by the photolithography technique. Power is supplied to the heat generating resistance 602 via the electrode 603 under control of the IC portion 605.

On the electrode 603 and heat generating resistance 602, a protective layer 604 of hard ceramics such as Si—O—N or Si—Al—O—N is laminated by sputtering for preventing the oxidization and wear of the electrode 603 and heat generating resistance 602.

The thermally-activating thermal head 400 of the above arrangement and the platen roller 401 are operated at a predetermined timing under control of the unillustrated control unit. The heat-sensitive self-adhesive label R having the heat-sensitive color developing layer 501, a colored print layer 502 and a thermally-active adhesive layer K, as shown in FIG. 10, is activated at the thermally-active adhesive layer K by heat generated by energizing the thermally-activating thermal head 400, so that an adhesive force is developed.

After the adhesive force of the heat-sensitive self-adhesive label R is developed by the thermal printer unit P2 thus arranged, an indication label, price label or advertisement label may be affixed to glass bottles containing liquors or medical agents or to plastic containers. This negates the need for a separation sheet (liner) provided at the adhesive label sheet commonly used in the art, providing a merit of cost reduction. In addition, the invention provides further merits in terms of resource savings and environmental problems because the separation sheets producing wastes after use are not required.

However, the conventional thermal activation unit A2 for heat-sensitive self-adhesive label R encounters a problem that the heat-sensitive adhesive and substances transformed therefrom (chemically changed or carbonized substances by heat) are adhered to the surface (protective layer 604) of the thermal head 400.

Specifically, as shown in FIG. 12A, the platen roller 401 is constantly pressed against the surface of the protective layer 604 of the thermal head 400. When the heat-sensitive self-adhesive label R cut in the predetermined length by the cutter unit C2 is inserted between the platen roller 401 and the protective layer 604, the thermally-active adhesive layer K is heated by the heat generating resistance 602 of the thermally-activating thermal head 400 to form a dwelling molten mass K1 of thermally active adhesive.

The most of the molten mass K1 adheres to individual surfaces of the thermally-active adhesive layers K of the heat-sensitive self-adhesive labels R delivered one after another, and is discharged along the movement of the heat-sensitive self-adhesive labels R. The discharged molten mass K1 is allowed to cool to form a solid mass on the protective layer 604. The solid mass gradually accumulates to form a fixed mass G1.

The fixed mass G1 thus formed interferes with the movement of the heat-sensitive self-adhesive label R, so that the molten mass K1 of the thermally active adhesive cannot be discharged from space between the protective layer 604 and the platen roller 401.

While dwelling at place between the protective layer 604 and the platen roller 401, the molten mass K1 of the thermally active adhesive is subject to thermal energy for a relatively long period of time, whereby the thermally activated adhesive is transformed into chemically changed or carbonized substances which are rigidly fixed to a surface portion of the protective layer 604 directly above the heat generating resistance 602 (in a scorchedly fixed state, for instance). In such a scorchedly fixed state, thermal conductivity from the heat generating resistance 602 to the thermally-active adhesive layer K of the heat-sensitive self-adhesive label R is decreased, resulting in a drawback of lowered cohesive strength of the heat-sensitive self-adhesive label R.

In order to ensure that the thermal activation unit A2 positively heats a leading and a trailing portion of the thermally-active adhesive layer K of the heat-sensitive self-adhesive label R, the control is provided such that power supply to the heat generating resistance 602 is started a few moments before the arrival of the leading portion and is continued for a few moments after the passage of the trailing portion. This produces some period of time during which the heat-sensitive self-adhesive label R is absent at place between the protective layer 604 and the platen roller 401. In this state, therefore, the platen roller 401 is at idle as contacting the protective layer 604. This leads to a problem that the molten mass K1 of the thermally active adhesive on the protective layer 604 adheres to a periphery of the idling platen roller 401 (refer to a sign G2 in FIG. 12B).

Furthermore, there may be a case where the thermally-active adhesive masses G2 on the periphery of the platen roller 401 are repeatedly heated by the heat generating resistance 602 so as to be transformed into chemically changed or carbonized substances, which are rigidly fixed to the periphery of the platen roller 401.

In another case, the thermally-active adhesive masses G2 on the periphery of the platen roller 401 are molten by repeated heating by the heat generating resistance 602, thus exhibiting a strong adhesive force. Accordingly, some of the adhesive masses G2 are adhered to a front surface of the subsequent heat-sensitive self-adhesive label R, contaminating the printable surface thereof.

Furthermore, there exists a problem that the peripheral surface of the platen roller 401 is deteriorated in smoothness due to the adherence of multiple thermally-active adhesive masses G2 and hence, the subsequent heat-sensitive self-adhesive label R cannot be uniformly heated, thus failing to exhibit a sufficient adhesive force.

In still another problem, some of the thermally-active adhesive masses G2 on the periphery of the platen roller 401 are re-adhered to the protective layer 604 on a side where the heat-sensitive self-adhesive label R is inserted, thus forming a deposition G3 thereon. The deposition G3 is gradually accumulated to a degree that the insertion of the subsequent heat-sensitive self-adhesive label R is blocked.

The insertion failure of the heat-sensitive self-adhesive label R associated with the deposition G3 results in a long idling of the platen roller 401. This increases load on a drive motor for the platen roller 401, accelerating the deterioration of the motor. Furthermore, since the heat from the heat generating resistance 602 is not absorbed by the heat-sensitive self-adhesive label R, thermal load is increased to shorten the service life of the heat generating resistance 602.

The aforementioned problems are encountered not only by the thermal head of the thermal activation unit but also by the printing thermal head 100.

SUMMARY OF THE INVENTION

The invention has been contrived to solve the above problems and has an object to provide a thermal head capable of preventing the adherence of a thermally active component, a thermal activation device for thermally active sheet employing the thermal head, and a printer assembly employing the thermal activation device.

For achieving the above objects, a thermal head (H) according to the invention comprises a heat storage layer (glaze layer 2) formed on a heat releasing substrate (ceramic substrate 1), a plurality of heat generating resistances (3) and electrodes (4*a*, 4*b*) for power supply to the individual heat generating resistances formed on the heat storage layer thereby forming an array of heat generating elements, and a protective layer (7) covering the top surfaces of these parts; and applies thermal activation energy to a print medium (heat-sensitive self-adhesive label R) including a thermally active component by supplying power to the heat-generating element array; the thermal head characterized in that two substantially parallel lines of anti-adherence layers against thermally-active-component (8*a*, 8*b*) are formed on the protective layer as sandwiching a protective layer portion directly above the heat-generating element array.

Thus, the thermally active component activated by receiving the thermal energy from the heat-generating element array is discharged from the portion directly above the heat-generating element array onto the anti-adherence layer against thermally-active-component so as to be prevented from forming the deposition. Accordingly, the problem associated with the thermally active component dwelling on the portion directly above the heat-generating element array can be obviated. This, therefore, prevents the scorched fixing of the thermally active component onto the protective layer, which is encountered in the prior art. Hence, the drawback of decreased thermal conductivity to the print medium including the thermally active component can be avoided.

Further, the anti-adherence layer against thermally-active-component may comprise a resin layer of low surface energy. Thus, the adherence of the thermally active component is effectively prevented by the resin layer of low surface energy which exhibits, for example, water or oil repellency. Further, the resin layer of low surface energy may have a pencil hardness in the range of 2 B to 5 B. This provides a more effective prevention of the adherence of the thermally active component because whenever the print medium including the thermally active component is inserted between the thermal head and the platen roller, the print medium contacts the resin layer to polish the surface of the resin layer, thereby constantly exposing a new surface of the resin layer.

Further, the resin layer of low surface energy may comprise a silicone resin or fluorine resin. This leads to an easy formation of the resin layer of low surface energy.

Further, the resin layer of low surface energy may comprise a fluorine resin layer containing a minor amount of powder of Si-based, Ti-based or Ta-based oxide or nitride film or complex film of these compounds. This leads to a resin layer featuring high water or oil repellency and enhanced film strength.

Further, the resin layer of low surface energy may comprise a fluorine resin containing a minor amount of metal element or carbon. This leads to the formation of a resin layer featuring high water or oil repellency, conductivity and resistance to electrostatic destruction.

Further, the anti-adherence layer against thermally-active-component may be composed to satisfy a relation $T \leqq W/100$ where T denotes a thickness of the anti-adherence layer against thermally-active-component, and W denotes a gap between two lines of anti-adherence layers against thermally-active-component. This ensures adequate surface contact between the anti-adherence layer against thermally-active-component and the print medium such that the surface of the resin layer is efficiently polished for more effective prevention of the adherence of the thermally active component.

Further, the two lines of anti-adherence layers against thermally-active-component may be tapered at opposite faces thereof. This provides an increased contact surface between the anti-adherence layer against thermally-active-component and the print medium such that the surface of the resin layer is efficiently polished for more effective prevention of the adherence of the thermally active component.

Further, in a case where the heat-generating element array has a convex or mesa-like section, the anti-adherence layer against thermally-active-component may be formed in a manner that a top surface of the anti-adherence layer is lower than a surface directly above the heat-generating element array. This permits the use of a simple procedure for forming the anti-adherence layer against thermally-active-component, negating the need for film thickness control taken when the anti-adherence layer against thermally-active-component is formed by coating a liquid material.

Further, the anti-adherence layer against thermally-active-component may be formed by applying a liquid resin material onto the protective layer. Thus, the anti-adherence layer against thermally-active-component can be readily formed from the liquid resin material by, for example, screen printing, dip coating, spray coating, brush coating or the like.

Further, the anti-adherence layer against thermally-active-component may be affixed to the protective layer via an adhesive layer. This provides a mode wherein a sheet-like body previously formed with the anti-adherence layer against thermally-active-component is provided with the adhesive layer at a back side thereof, such that the anti-adherence layer against thermally-active-component may be readily mounted to place by affixing the sheet-like body. This also facilitates the replacement of the anti-adherence layer against thermally-active-component when the anti-adherence layer is worn or damaged.

A thermal activation device for thermally active sheet according to another aspect of the invention at least comprises activating heating means for activating by heating a thermally active layer of a thermally active sheet formed with the thermally active layer at least on one side of a sheet-like substrate thereof; conveyance means for conveying the thermally active sheet in a predetermined direction; and pressure means for pressing the thermally active sheet against the activating heating means, the device characterized in that the above thermal head is employed as the activating heating means.

This ensures that the adherence of the thermally active component to the thermal head is effectively prevented and hence, the thermal activation device for thermally active sheet featuring high thermal conductivity to the print medium is provided.

A printer assembly according to another aspect of the invention comprises the above thermal activation device for thermally active sheet. Thus is provided the printer assembly always capable of thermally activating the printed print medium with good thermal conductivity.

Further, the printer assembly is characterized in that the thermally active sheet may be formed with a heat-sensitive color developing layer, and that the above thermal head may be employed as thermal activation means for the heat-sensitive color developing layer. This ensures that the print medium is always thermally activated with good thermal conductivity while a component of the heat-sensitive color developing layer is prevented from adhering to the surface of the thermal head. Hence, favorable printing results can be obtained.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Preferred embodiments of the invention will hereinbelow be described in detail with reference to the accompanying drawings.

Figure 1:
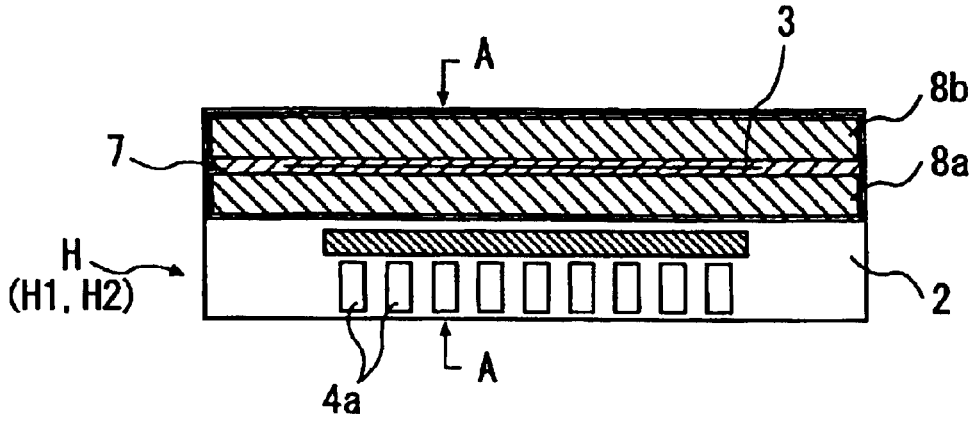
FIG. 1 is a plan view showing an arrangement of a thermal head according to a first embodiment of the invention.
Figure 2:
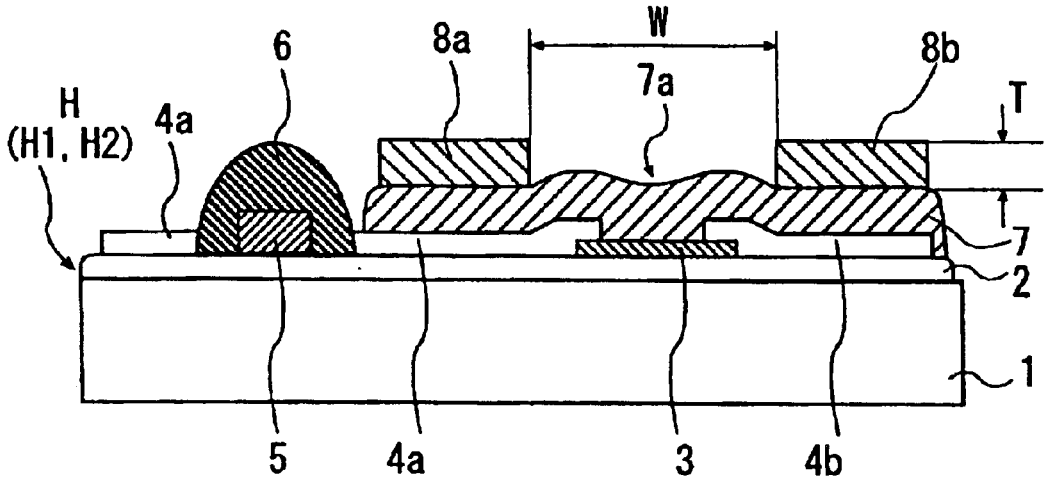
FIG. 2 is a sectional view taken on the line A—A for showing the arrangement of the thermal head according to the first embodiment.
Figure 3:
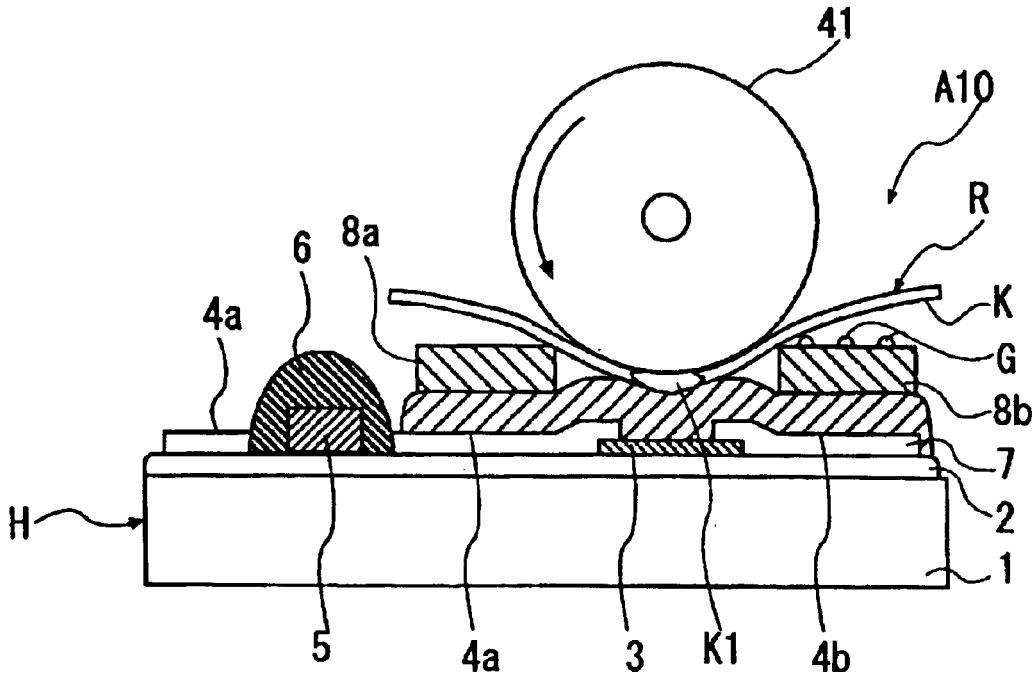
FIG. 3 is a schematic diagram showing an arrangement of a thermal activation device employing the thermal head according to the first embodiment.

FIG. 1 is a plan view showing a thermal head according to a first embodiment of the invention. FIG. 2 is a sectional view of the thermal head taken on the line A—A. FIG. 3 is a schematic diagram showing an arrangement of a thermal activation device employing the thermal head.

Referring to FIG. 2, a reference sign H represents the whole body of the thermal head, whereas a numeral 1 represents a ceramic substrate as a heat releasing substrate.

A glaze layer 2 as a heat storage layer is formed in a thickness of say 60 $\mu$m on the overall surface of the ceramic substrate 1. The glaze layer 2 may be formed by, for example, printing a glass paste and baking the glass paste at predetermined temperatures (e.g., about 1300 to 1500° C.).

A heat generating resistance 3, such as of Ta—$SiO_2$, is formed on the glaze layer 2 by laminating a Ta—$SiO_2$ film by sputtering or the like and processing the resultant film into a predetermined pattern by the photolithography technique. Also formed on the glaze layer 2 is an IC portion 5 for controlling power supply to the heat generating resistance 3. A sealing portion 6, such as of a resin, is laid over the IC portion for protection.

On the heat generating resistance 3, electrodes 4*a,* 4*b* are formed by, for example, laminating a layer of Al, Cu, Au or the like in a thickness of about 2 $\mu$m and processing the layer into respective predetermined patterns by the photolithography technique. The power is supplied to the heat generating resistance 3 via the electrodes 4*a,* 4*b* under the control of the IC portion 5.

A protective layer 7 of hard ceramics, such as Si—O—N, or Si—Al—O—N, is overlaid on the electrodes 4*a,* 4*b* and heat generating resistance 3 by sputtering or the like in order to prevent the oxidization or wear of the electrodes 4*a,* 4*b* and heat generating resistance 3.

On the protective layer 7, there are provided two substantially parallel lines of anti-adherence layers against thermally-active-component 8*a,* 8*b,* which sandwich therebetween a protective layer portion directly above the heat generating resistance 3. The anti-adherence layers against thermally-active-component 8*a,* 8*b* include a resin layer of low surface energy which is capable of exhibiting water or oil repellency. Specifically, the anti-adherence layer may include a silicone resin; a fluorine resin; a fluorine resin layer containing a minor amount of powder of Si-based, Ti-based or Ta-based oxide or nitride film or complex film of these compounds; or a fluorine resin containing a minor amount of metal element or carbon.

A method for forming the anti-adherence layers against thermally-active-component 8*a,* 8*b* based on any of the above resins is not particularly limited. The anti-adherence layer may be formed from a liquid material using any of the processes such as screen printing, dip coating, spray coating and brush coating. In this process, it is desirable to apply a masking tape or masking plate to a protective layer portion 7*a* representing the portion directly above the heat generating resistance 3 for preventing the resin from adhering to the protective layer portion.

Alternatively, the anti-adherence layer against thermally-active-component 8*a,* 8*b* may be formed by the steps of coating the resin on the overall surface of the protective layer 7 and removing an unrequired portion by mechanical etching or chemical etching technique with required portions covered by a masking tape, masking plate or photoresist agent. In this case, the resin layer may be tacked by drying or the like prior to the etching process or the like.

Any of the drying processes including heat curing, UV-curing, chemical reaction such as with an agent, water, oxygen or the like, and drying through evaporation of a contained agent may be adopted depending upon the properties of the used resin.

In the case of poor adhesiveness between the surface of the protective layer 7 and the resin material, an intermediate layer (primer) of excellent adhesiveness may be interposed, or otherwise, the surface of the protective layer 7 may be increased in surface roughness by mechanical or chemical polishing, thereby achieving improved adhesiveness to the resin material.

It is preferred that the anti-adherence layer against thermally-active-component 8*a,* 8*b* has a pencil hardness in the range of 2 B to 5 B, although such a hardness may vary depending upon the type of the heat-sensitive self-adhesive label R as a print medium including the thermally active component. The hardness can be controlled by way of the type and amount of an additive used in the resin, for example.

In a thermal activation device A10 including the thermal head H as shown in FIG. 3, the adherence of the thermally active component to the thermal head H may be more effectively prevented by limiting the hardness of the anti-adherence layers against thermally-active-component 8*a*, 8*b* in this range, because whenever the heat-sensitive self-adhesive label R is inserted between the thermal head H and a platen roller 41, the heat-sensitive self-adhesive label R contacts the surfaces of the anti-adherence layers against thermally-active-component 8*a*, 8*b* to polish the surfaces thereof, thereby constantly exposing new surfaces of the anti-adherence layers 8*a*, 8*b*.

It is preferred that the anti-adherence layers against thermally-active-component 8*a*, 8*b* have a thickness satisfying a relation $T \leqq W/100$ where 'T' denotes a thickness of the anti-adherence layers 8*a*, 8*b*, and 'W' denotes a gap between the two lines of anti-adherence layers 8*a*, 8*b*. This relation ensures adequate contact between the anti-adherence layers against thermally-active-component 8*a*, 8*b* and the heat-sensitive self-adhesive label R, whereby the surfaces of the anti-adherence layers 8*a*, 8*b* are efficiently polished for more effective prevention of the adherence of the thermally active component.

Referring to FIG. 3, the molten mass of thermally active component K1 dwelling at place between the thermal head H and the platen roller 41 adheres to a back side of the individual heat-sensitive self-adhesive labels R sequentially delivered thereto so as to be discharged onto the anti-adherence layer 8*b*. The discharged molten mass is cooled to solidify, thus forming granular residues, such as represented by a sign G, which, unlike those encountered by the prior art, are prevented from being rigidly fixed to the anti-adherence layer 8*b* by virtue of the water or oil repellency thereof. When the thermal activation device A10 is at rest, therefore, the granular residues G may be readily removed by lightly wiping the surface of the anti-adherence layer against thermally-active-component 8*b* using cloth or the like.

In this manner, the solidified thermally active component can be prevented from accumulating on the surface of the anti-adherence layer against thermally-active-component 8*b*, so that the molten mass of thermally active component K1 dwelling at place between the thermal head H and the platen roller 41 can be fully discharged to the anti-adherence layer 8*b*. In contrast to the prior art, therefore, the occurrence of the following state (the scorchedly fixed state of the component, for instance) can be obviated. That is, the molten mass of thermally active component K1 between the thermal head H and the platen roller 41 is subject to the thermal energy for long hours so as to be transformed into chemically changed or carbonized substances which are rigidly fixed to the surface portion of the protective layer 7 that is directly above the heat generating resistance 3.

The arrangement of the thermal head H is not limited to the embodiment shown in FIGS. 1 and 2. For instance, a thermal head H100 according to a second embodiment of the invention, as shown in FIG. 4, illustrates an arrangement wherein anti-adherence layers against thermally-active-component 704*a*, 704*b* are tapered at opposite faces 704*a*1, 704*b*1 thereof.

Figure 4:
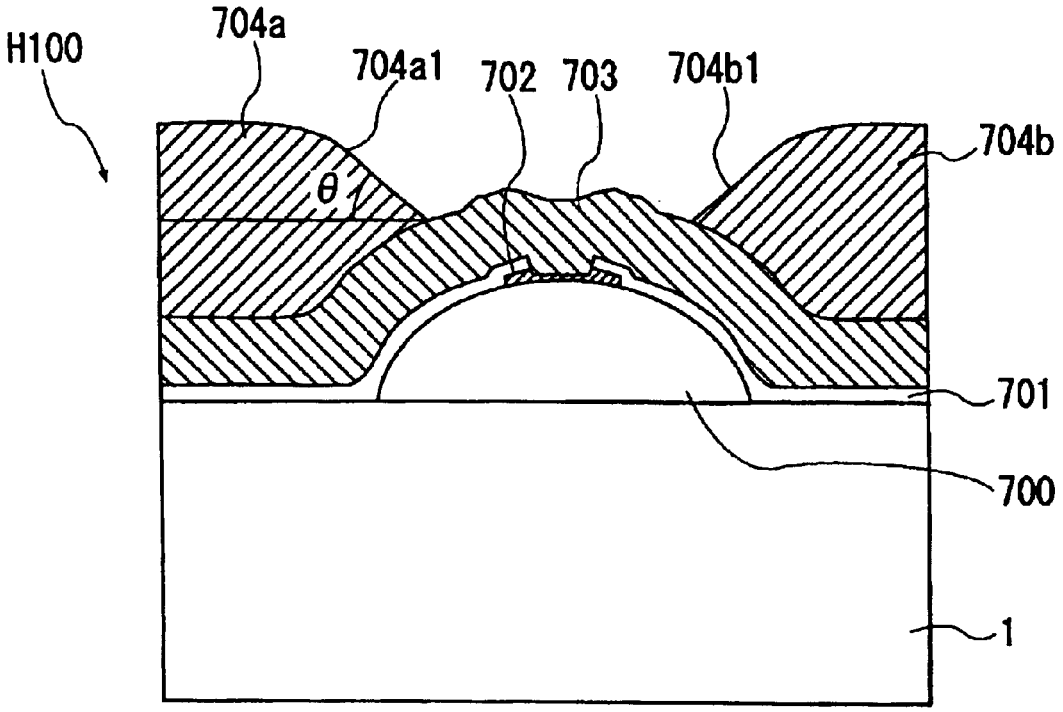
FIG. 4 is a sectional view showing an arrangement of a thermal head according to a second embodiment of the invention.

Referring to the sectional view of FIG. 4, a convex glaze layer 700 as the heat storage layer is laminated in a predetermined thickness on the ceramic substrate 1. Atop the glaze layer 700, a layer such as of Ta—$SiO_2$ is overlaid by sputtering and processed using the photolithography technique, thereby forming a heat generating resistance 702 of a predetermined pattern.

Over the ceramic substrate 1, glaze layer 700 and heat generating resistance 702, an electrode 701 of a predetermined pattern is formed by laminating a layer of Al, Cu, Au or the like in a thickness of about 2 $\mu$m by sputtering and processing the resultant layer using the photolithography technique.

A protective layer 703 of hard ceramics such as Si—O—N or Si—Al—O—N is laminated on the electrode 701 and the heat generating resistance 702 by sputtering or the like for the purpose of preventing the oxidization or wear of the electrode 701 and heat generating resistance 702.

On the protective layer 703, the two lines of anti-adherence layers against thermally-active-component 704*a*, 704*b* are formed in substantially parallel relation as sandwiching therebetween a protective layer portion directly above the heat generating resistance 702 and glaze layer 700. In addition, the opposite faces 704*a*1, 704*b*1 of the anti-adherence layers against thermally-active-component 704*a*, 704*b* are tapered at a taper angle ($\theta$) of say 45 degrees.

Such tapers may be formed by any of the known techniques. In a case where the anti-adherence layers against thermally-active-component 704*a*, 704*b* are formed by screen printing using a liquid resin, for example, the opposite faces may be allowed to incline naturally into the tapered structure by reducing the viscosity of the liquid resin or using slower curing conditions.

Alternatively, the formation of the anti-adhesive layers against thermally-active-component 704*a*, 704*b* may be carried out in two steps including forming an under layer using a resin of higher viscosity and forming an upper layer using a resin of lower viscosity, thereby allowing the opposite faces to incline naturally into the tapered structure. In another approach, the tapered structure may be formed by coating the resin by screen printing or brush coating, followed by etching the opposite faces by mechanical etching or chemical etching.

An increased contact surface between the anti-adhesive layers against thermally-active-component 704*a*, 704*b* and the heat-sensitive self-adhesive label R can be attained by tapering the opposite faces 704*a*1, 704*b*1 of the anti-adherence layers 704*a*, 704*b*. This provides an efficient polishing of the surfaces of the anti-adherence layers against thermally-active-component 704*a*, 704*b* for more effective prevention of the adherence of the thermally active component.

Figure 5:
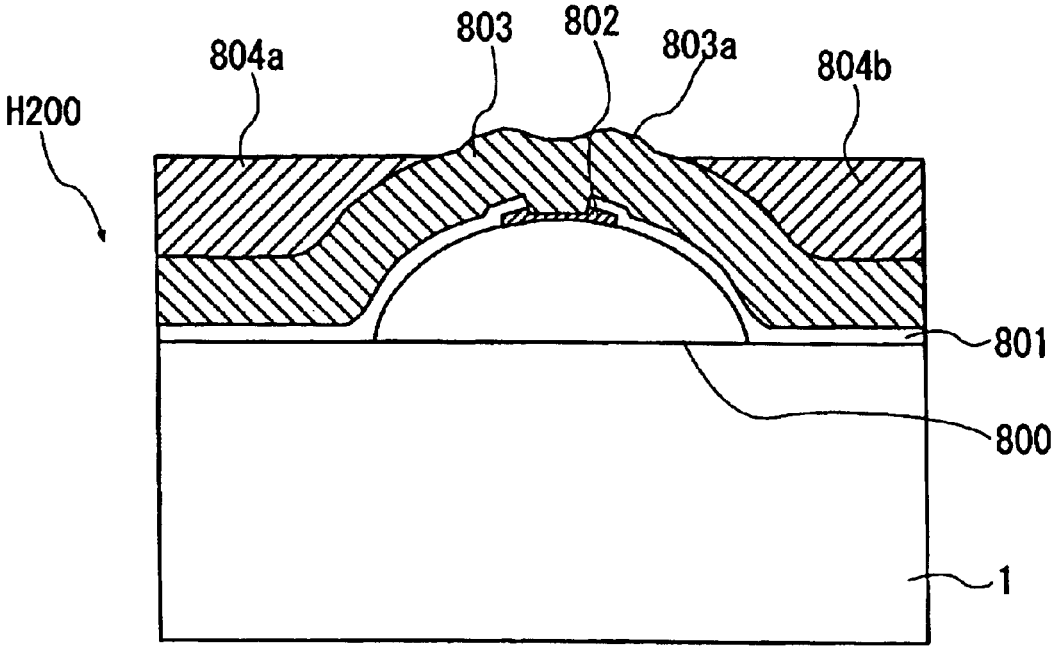
FIG. 5 is a sectional view showing an arrangement of a thermal head according to a third embodiment of the invention.

FIG. 5 illustrates a thermal head H200 according to a third embodiment of the invention. The thermal head H200 according to the third embodiment has an arrangement wherein surfaces of anti-adherence layers against thermally-active-component 804*a*, 804*b* are at a lower level than a surface portion 803*a* directly above a heat generating resistance 802.

Referring to the sectional view of FIG. 5, a convex or mesa-like glaze layer 800 as the heat storage layer is laminated in a predetermined thickness on the ceramic substrate 1. Atop the glaze layer 800, the heat generating resistance 802 such as of Ta—$SiO_2$ is formed by laminating the Ta—$SiO_2$ layer by sputtering or the like, followed by processing the layer into a predetermined pattern using the photolithography technique.

Over the ceramic substrate 1, glaze layer 800 and heat generating resistance 802, an electrode 801 of a predetermined pattern is formed by laminating a layer of Al, Cu, Au or the like in a thickness of about 2 μm by sputtering or the like, followed by processing the resultant layer using the photolithography technique.

The protective layer 803 of hard ceramics such as Si—O—N or Si—Al—O—N is laminated onto the electrode 801 and heat generating resistance 802 by sputtering or the like for the purpose of preventing the oxidization or wear of the electrode 801 and heat generating resistance 802.

On the protective layer 803, two substantially parallel lines of anti-adherence layers against thermally-active-component 804*a,* 804*b* are so formed as to be positioned at a lower level than the surface portion 803*a* directly above the heat generating resistance 802. The formation of the anti-adherence layers against thermally-active-component 804*a,* 804*b* is not particularly limited, and may be formed from a liquid resin using any of the processes such as screen printing, dip coating, spray coating and brush coating. Such a process provides the anti-adherence layers against thermally-active-component 804*a,* 804*b* having a thickness of say 10 μm or less.

This negates the need for film thickness control taken when the anti-adherence layers against thermally-active-component 804*a,* 804*b* are formed by coating a liquid material. Hence, a simple procedure may be taken to form the anti-adherence layers against thermally-active-component 804*a,* 804*b.*

Although the aforementioned first to third embodiments illustrate the case where the anti-adherence layers against thermally-active-component are directly formed on the protective layer by coating or printing the liquid resin, the method for forming the anti-adherence layers against thermally-active-component is not limited to this.

Figure 6:
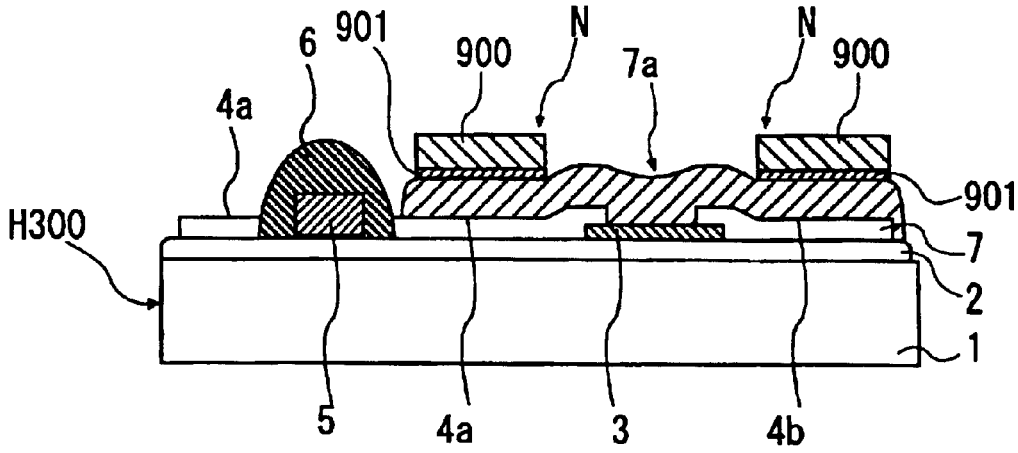
FIG. 6 is a sectional view showing an arrangement of a thermal head according to a fourth embodiment of the invention.

For instance, a thermal head H300 according to a fourth embodiment of the invention, as shown in FIG. 6, is adapted to prevent the adherence of the thermally active component by way of a seal-like anti-adherence member against thermally-active-component N affixed to the surface of the protective layer 7, the anti-adherence member N including an anti-adherence layer against thermally-active-component 900 formed on a self-adhesive sheet 901.

In this case, a worn or damaged anti-adherence layer against thermally-active-component 900 may be readily serviced by peeling off the old anti-adherence member against thermally-active-component N and affixing a new one. Hence, the thermal head is improved in convenience characteristic thereof.

The aforementioned FIG. 3 illustrates the example where the thermal head H according to the embodiment is applied to the thermal activation device A10. However, the application of the thermal head H is not limited to this and the thermal head H is also applicable to a thermal printer assembly. Hereinafter, description will be made on a printer assembly.

Figure 7:
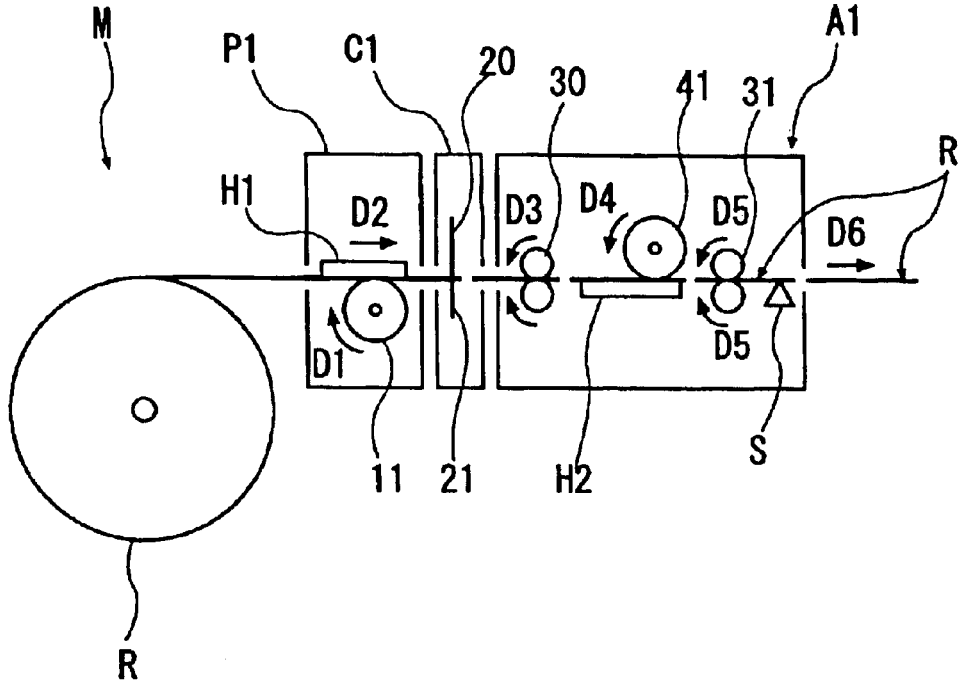
FIG. 7 is a schematic diagram showing an arrangement of a printer assembly employing the thermal head according to the invention.

FIG. 7 schematically shows an arrangement of a printer assembly M which applies the thermal head H to a thermal printer unit and a thermal activation unit.

Referring to FIG. 7, a reference sign P1 represents a thermal printer unit, a sign C1 representing a cutter unit, a sign A1 representing a thermal activation unit as the thermal activation device, the sign R representing the heat-sensitive self-adhesive label as a thermally active sheet (print medium) wound into a roll. The thermal printer unit P1 includes a printing thermal head H1 for printing operation having substantially the same arrangement as the aforementioned thermal head H; a platen roller 11 pressed against the printing thermal head H1; and an unillustrated drive system for rotating the platen roller 11 (including, for example, a first stepping motor and a gear array).

The platen roller 11 is rotated in the direction D1 (clockwise) as seen in FIG. 7 thereby paying out the heat-sensitive self-adhesive label R, which is subjected to thermal printing and discharged in the direction D2 (rightward). The platen roller 11 includes unillustrated pressure means (such as a helical spring or plate spring) a resilient force of which acts to bias the platen roller 11 surface against the printing thermal head H1.

Figure 10:
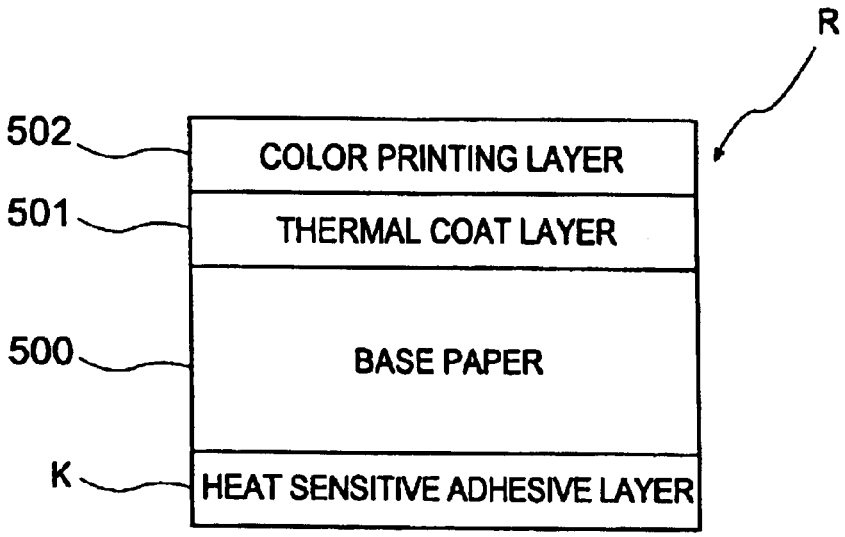
FIG. 10 is a sectional view showing an exemplary configuration of a thermally active sheet.
Figure 11:
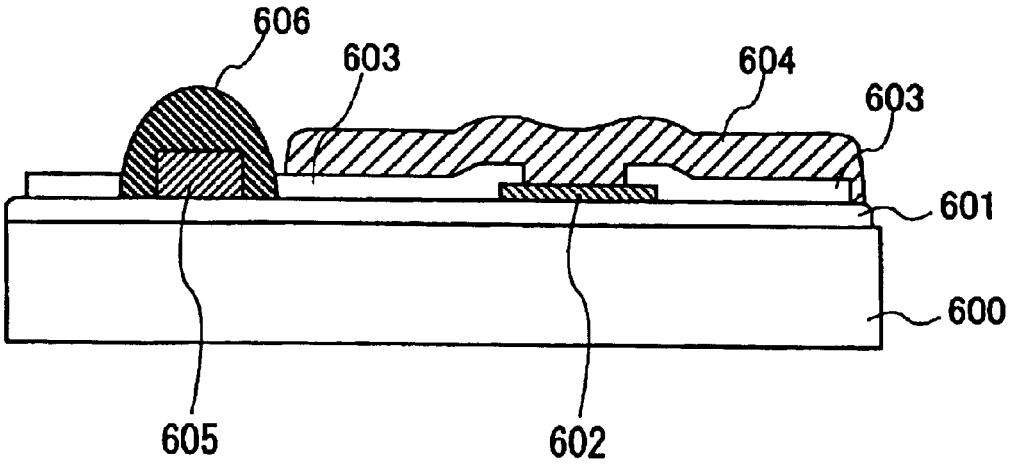
FIG. 11 PRIOR ART
FIG. 11 is a sectional view showing an arrangement of a conventional thermal head.
Figure 12A:
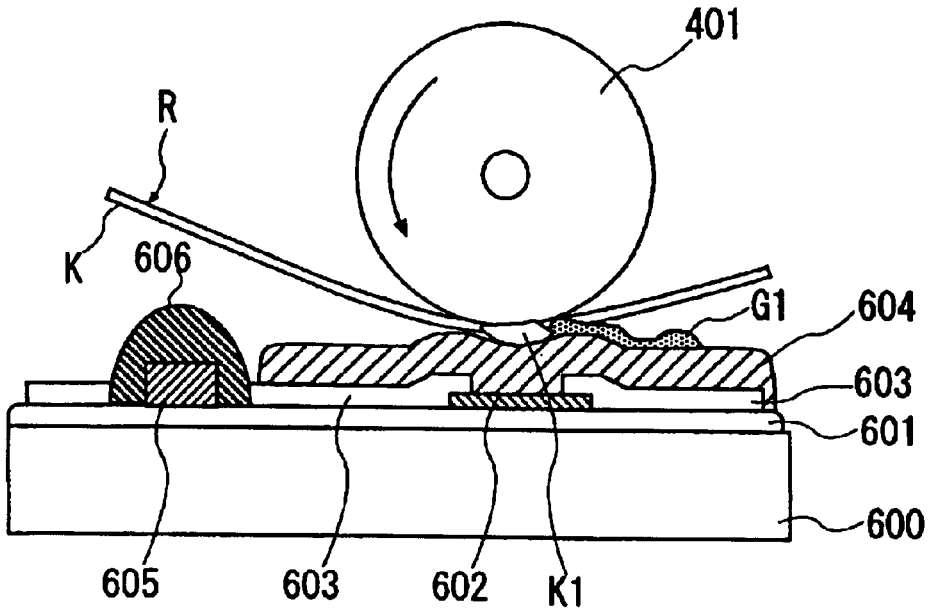
FIG. 12A PRIOR ART
FIG. 12 is a group of diagrams illustrative of states of a heat sensitive adhesive and the like adhered to the conventional thermal head.
Figure 12B:
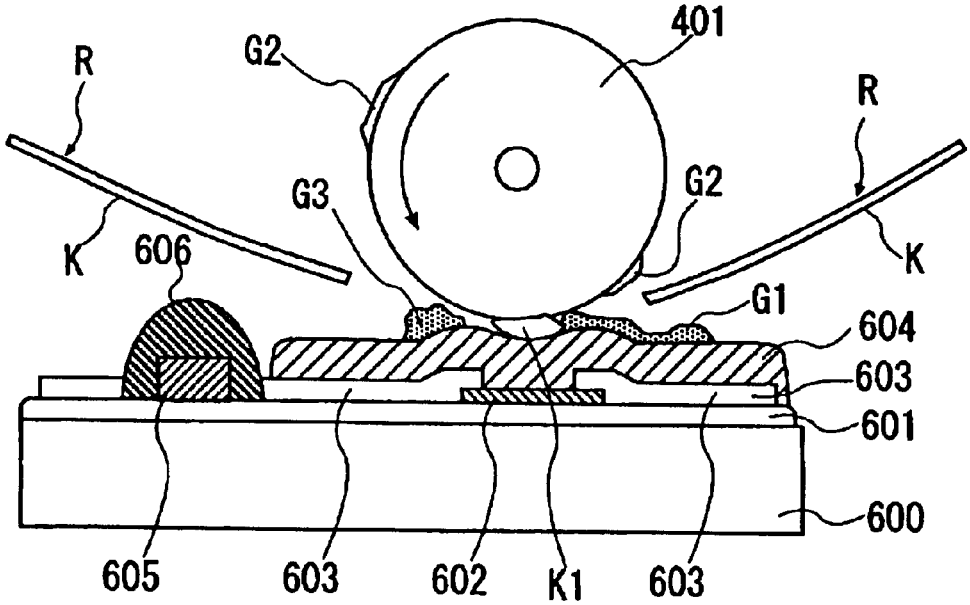
FIG. 12B PRIOR ART

A heat generating resistance employed by the printing thermal head H1 of the embodiment includes a plurality of relatively small resistance elements arranged along a width of the head such as to permit dot printing. On the other hand, the heat-sensitive self-adhesive label R has the arrangement as shown in FIG. 10, for example. As required, a heat insulating layer may be formed on a base paper 500.

The printer assembly of the embodiment operates the printing thermal head H1 and printing platen roller 11 according to a print signal from a control unit 1500, to be described hereinlater, thereby effecting a desired printing on the thermal coat layer 501 of the heat-sensitive self-adhesive label R.

The cutter unit C1 serves to cut the heat-sensitive self-adhesive label R in a suitable length, the heat-sensitive adhesive label thermally printed by the thermal printer unit P1. The cutter unit C1 includes a movable blade 20 operated by a drive source (not shown) such as an electric motor, and a fixed blade 21 and the like. An unillustrated cutter driving portion 20A for the movable blade 20 is operated at a predetermined timing under control of the control unit 1500 described later.

The thermal activation unit A1 is rotated by an unillustrated drive source, for example, and includes an insertion roller 30 and a discharge roller 31 for insertion and discharge of the cut heat-sensitive self-adhesive label R; a thermally-activating thermal head H2 interposed between the insertion roller 30 and discharge roller 31 and having the same arrangement as the aforementioned thermal head H; and the thermally-activating platen roller 41 pressed against the thermally-activating thermal head H2. The thermally-activating platen roller 41 includes a drive system (including a stepping motor and gear array, for example), which rotates the platen roller 41 in the direction D4 (the counterclockwise direction as seen in FIG. 7) so that the heat-sensitive adhesive label R is conveyed in the direction D6 (the rightward direction as seen in FIG. 7) by the insertion roller 30 and discharge roller 31 rotated in the respective directions D3 and D5. The thermally-activating platen roller 41 is formed of, for example, a hard rubber or the like.

Referring to FIG. 7, the reference sign S represents a heat-sensitive self-adhesive label detection sensor as thermally-active-sheet detection means for sensing a position of the heat-sensitive self-adhesive label R. The sensor includes a photo sensor, micro switch or the like.

It is noted that any one of the thermal heads having the arrangements shown in FIGS. 4 to 6 may be used in place of the thermal head H as the printing thermal head H1 and the thermally-activating thermal head H2.

Figure 8:
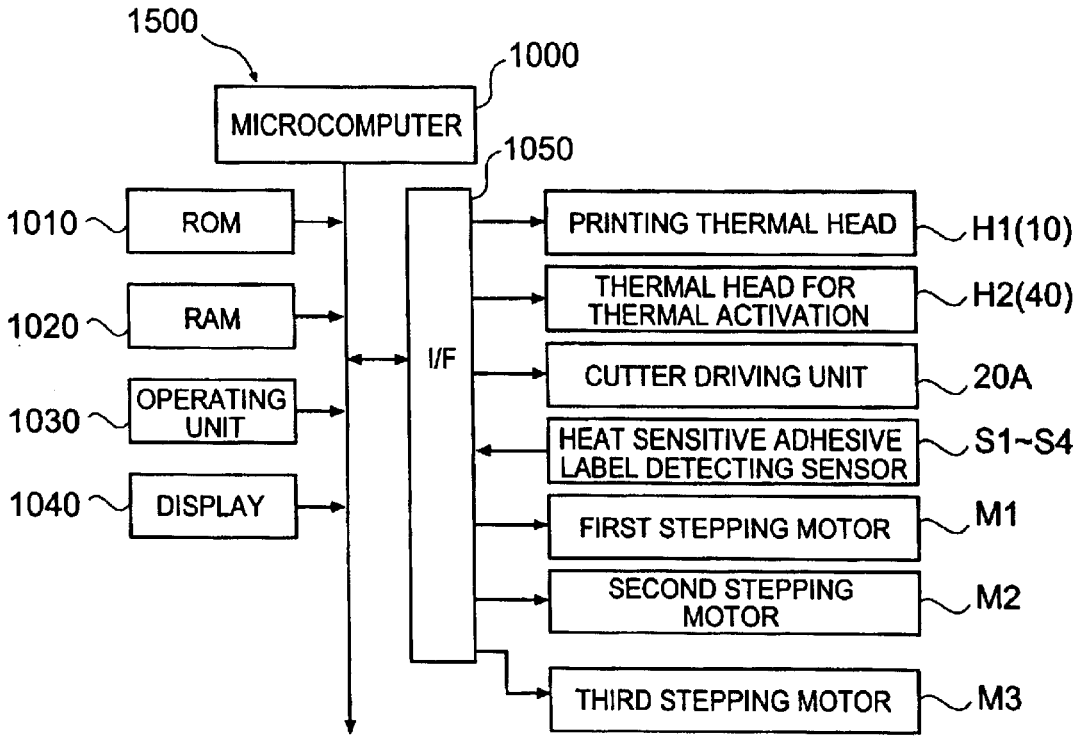
FIG. 8 is a block diagram showing an arrangement of a control unit of the printer assembly.
Figure 9:
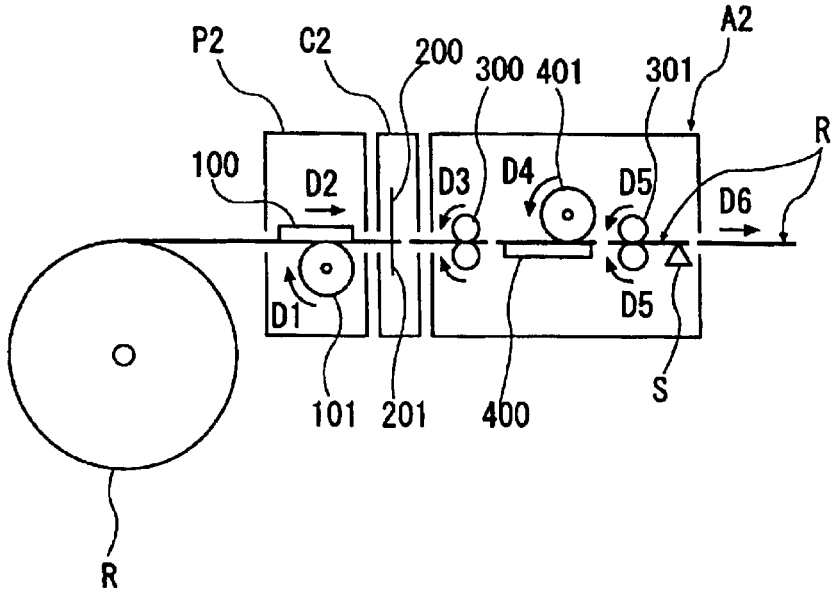
FIG. 9 PRIOR ART
FIG. 9 is a schematic diagram showing an arrangement of a conventional thermal printer assembly.

As shown in FIG. 8, the control unit 1500 of the thermal printer assembly includes a one-chip microcomputer 1000 for governing the control unit; a ROM 1010 for storing a control program executed by the microcomputer 1000; a RAM 1020 for storing a variety of print formats and the like; an operation portion 1030 for inputting, defining or retrieving printing data, print format data and the like; a display portion 1040 including a liquid crystal display panel for displaying the printing data and the like; and an interface 1050 responsible for data input or output between the control unit and the drive unit.

The interface 1050 is connected with the printing thermal head H1 of the printer unit P1, the thermally-activating thermal head H2 of the thermal activation unit A1, the cutter driving portion 20A of the cutter unit C1, first to third stepping motors M1 to M3, and the heat-sensitive self-adhesive label detection sensor S.

When the thermal printer assembly is brought into operation under the control of the control unit 1500, the thermal printer unit P1 first thermally prints on the printable surface (thermal coat layer 501) of the heat-sensitive self-adhesive label R.

At this time, by virtue of the arrangement of the printing thermal head H1 shown in FIGS. 1 and 2 and the characteristics of the anti-adherence layers against thermally-active-component 8*a* and 8*b*, the printing thermal head H1 is always capable of thermally activating the heat-sensitive self-adhesive label R with good thermal conductivity, without suffering the adherence of the component of the heat-sensitive color developing layer (the colored print layer 502) to the surface of the protective layer 7 of the thermal head H1. Thus, favorable printing results can be obtained.

Subsequently, the heat-sensitive self-adhesive label R is delivered by the rotating printing platen roller 11 to the cutter unit C1, where the self-adhesive label R is cut in a predetermined length by the movable blade 20 operated by the cutter driving portion 20A at a predetermined timing.

Subsequently, the heat-sensitive self-adhesive label R thus cut is introduced into the thermal activation unit A1 by the insertion roller 30 of the thermal activation unit A1 and then applied with the thermal energy by the thermally-activating thermal head H2 and thermally-activating platen roller 41 operated at a predetermined timing. Thus, the thermally-active adhesive layer K of the heat-sensitive self-adhesive label R is activated to develop the adhesive force.

In this process, the molten mass of thermally active component K1 dwells at place between the thermally-activating thermal head H2 and platen roller 41, and adheres to the individual back sides of the heat-sensitive self-adhesive labels R delivered thereto one after another, so as to be discharged onto the anti-adherence layer against thermally-active-component 8*b*. The molten mass is cooled to solidify into, for example, the granular residues represented by the sign G, as shown in FIG. 3. In contrast to the prior art suffering the rigid adherence of the residues, the water or oil repellency of the anti-adherence layer against thermally-active-component 8*b* eliminates the rigid adherence of the granular residues to the anti-adherence layer surface. When the thermal activation unit A1 is at rest, therefore, the granular residues G can be readily removed by lightly wiping the surface of the anti-adherence layer against thermally-active-component 8*b* using cloth or the like.

As described above, the solid mass of thermally active component is prevented from accumulating on the surface of the anti-adherence layer against thermally-active-component 8*b* and hence, the molten mass of thermally active component K1 dwelling at place between the thermally-activating thermal head H2 and platen roller 41 can be fully discharged onto the anti-adherence layer against thermally-active-component 8*b*. In contrast to the prior art, therefore, the occurrence of the following state (the scorchedly fixed state of the component, for instance) can be obviated. That is, the molten mass of thermally active component K1 between the thermally-activating thermal head H and platen roller 41 is subject to the thermal energy for long hours so as to be transformed into chemically changed or carbonized substances which are rigidly fixed to the surface portion of the protective layer 7 that is directly above the heat generating resistance 3.

Although the invention accomplished by the inventors has been specifically described with reference to the embodiments thereof, it is to be understood that the invention is not limited to the foregoing embodiments but various changes and modifications may be made thereto within the scope of the invention.

For instance, in addition to the aforementioned components of the anti-adherence layer against thermally-active-component, organic materials containing a minor amount of powder of SiAlON (SIALON), $SiO_2$, SiC, Si—N, TiC, Ti—C, $TiO_2$, C (including diamond), Zr, ZrN or the like are also usable.

As mentioned supra, the thermal head according to the invention is arranged such that the heat storage layer is formed on the heat releasing substrate, that the array of heat generating elements is formed on the heat storage layer and includes the plural heat generating resistances and electrodes for power supply to the individual heat generating resistances, that the protective layer covers the top surfaces of these parts, and that the two substantially parallel lines of anti-adherence layers against thermally-active-component are formed on the protective layer as sandwiching therebetween the protective layer portion directly above the heat-generating element array. Therefore, the thermally active component activated by the thermal energy from the heat-generating element array is discharged from the protective layer portion directly above the heat generating element array onto the anti-adherence layer against thermally-active-component, thus prevented from dwelling at place directly above the heat generating element array. This leads to the prevention of the scorched fixing of the dwelling mass of thermally active component onto the protective layer, which is encountered in the prior art. Hence, the problem associated with the decreased thermal conductivity to the print medium including the thermally active component is effectively obviated.

What is claimed is:

1. A thermal head applying thermal activation energy to a print medium including a thermally active component by supplying power, comprising:

a heat releasing substrate releasing a heat, a heat storage layer formed on the heat releasing substrate, an array of heat generating elements formed on the heat storage layer and including a plurality of heat generating resistances and electrodes supplying power to the individual heat generating resitances, a protective layer covering the top surfaces of the array of heat generating elements, and an anti-adherence layers against thermally-active-component formed on the protective layer, wherein two substantially parallel lines of the anti-adherence layers against thermally-active-component are formed on the protective layer as sandwiching a protective layer portion directly above the heat-generating element array.

2. A thermal head according to claim 1, wherein the anti-adherence layer against thermally-active-component comprises a resin layer of low surface energy.

3. A thermal head according to claim 2, wherein the resin layer of low surface energy has a pencil hardness in the range of 2B to 5B.

4. A thermal head according to claim 2, wherein the resin layer of low surface energy comprises a silicone resin or fluorine resin.

5. A thermal head according to claim 2, wherein the resin layer of low surface energy comprises a fluorine resin layer containing a minor amount of powder of Si-based, Ti-based or Ta-based oxide or nitride film or complex film of these compounds.

6. A thermal head according to claim 2, wherein the resin layer of low surface energy comprises a fluorine resin containing a minor amount of metal element or carbon.

7. A thermal head according to claim 1, wherein the anti-adherence layer against thermally-active-component is composed to satisfy a relation:

$T \leqq W/100$, where T denotes a thickness of the anti-adherence layer against thermally-active-component and W denotes a gap between two lines of anti-adherence layers against thermally-active-component.

8. A thermal head according to claim 1, wherein the two lines of anti-adherence layers against thermally-active-component are tapered at opposite faces thereof.

9. A thermal head according to claim 1, in a case where the heat-generating element array has a convex or mesa-like section, the anti-adherence layer against thermally-active-component is formed in a manner that a top surface of the anti-adherence layer is lower than a surface directly above the heat-generating element array.

10. A thermal head according to claim 1, wherein the anti-adherence layer against thermally-active-component is formed by applying a liquid resin material onto the protective layer.

11. A thermal head according to claim 1, wherein the anti-adherence layer against thermally-active-component is affixed to the protective layer via an adhesive layer.

12. A thermal activation device for thermally active sheet at least comprising:

activating heating means for activating by heating a thermally active layer of a thermally active sheet formed with the thermally active layer at least on one side of a sheet-like substrate thereof, conveyance means for conveying the thermally active sheet in a predetermined direction, and pressure means for pressing the thermally active sheet against the activating heating means, wherein the thermal head according to claim 1 is employed as the activating heating means.

13. A printer assembly comprising the thermal activation device for thermally active sheet according to claim 12.

14. A printer assembly according to claim 13, wherein the thermally active sheet is formed with a heat-sensitive color developing layer.

* * * * *